US006312138B1

(12) United States Patent
Coleman, Jr. et al.

(10) Patent No.: US 6,312,138 B1
(45) Date of Patent: Nov. 6, 2001

(54) LIGHTED MAGNETIC RETRIEVAL TOOL

(76) Inventors: Edward S. Coleman, Jr., 116 Kesler Dr., Ridgefield, CT (US) 06877; Wen-Ruey Chang, No. 5, Alley 6, Lane 68, Taeeng Road, Taoyuan (TW)

( * ) Notice: Subject to any disclaimer, the term of this patent is extended or adjusted under 35 U.S.C. 154(b) by 0 days.

(21) Appl. No.: 09/419,044

(22) Filed: Oct. 15, 1999

(51) Int. Cl.[7] ..... B25B 23/18

(52) U.S. Cl. ..... 362/120; 362/119; 294/65.5

(58) Field of Search ..... 362/109, 119, 362/120; 294/65.5, 66.2; 335/285, 286, 291, 293

(56) References Cited

U.S. PATENT DOCUMENTS

| | | | | |
|---|---|---|---|---|
| 5,348,359 | | 9/1994 | Boozer | 294/24 |
| 5,381,319 | | 1/1995 | Shiao | 362/120 |
| 5,615,920 | * | 4/1997 | O'Kane | 294/65.5 |
| 5,647,623 | * | 7/1997 | Shiao | 294/65.5 |
| 5,704,674 | * | 1/1998 | Boozer | 294/65.5 |

* cited by examiner

*Primary Examiner*—Alan Cariaso
*Assistant Examiner*—Hargobind S. Sawhney
(74) *Attorney, Agent, or Firm*—Bachman & LaPointe, P.C.

(57) ABSTRACT

A lighted magnetic retrieval tool includes a magnet member having a pickup surface and an opening in the pickup surface; and a light member for directing light through the opening whereby light can be directed at objects to be retrieved with the pickup surface.

8 Claims, 1 Drawing Sheet

LIGHTED MAGNETIC RETRIEVAL TOOL

BACKGROUND OF THE INVENTION

The invention relates to the field of hand held tools and, more particularly, to a lighted magnetic retrieval tool.

Magnetic retrieval tools are useful for a wide variety of purposes such as retrieval of ferrous objects dropped in relatively inaccessible areas. Such areas may also be dark, rendering the object to be retrieved difficult to see. Several attempts have been made to overcome this problem as disclosed in U.S. Pat. No. 5,381,319 to Shiao and U.S. Pat. No. 5,348,359 to Boozer. In each of these patents, a tool is provided wherein a light can interchangeably be used through removal of the magnet member and the like. Obviously, this is not an ideal solution to the problem of retrieving ferrous objects from dark inaccessible areas.

The need remains for a simple and effective tool for retrieving ferrous articles from such dark and inaccessible areas.

It is therefore the primary object of the present invention to provide such a tool.

Other objects and advantages of the present invention will appear hereinbelow.

SUMMARY OF THE INVENTION

In accordance with the invention, the foregoing objects and advantages have been readily attained.

According to the invention, a tool is provided which comprises a magnet member having a pickup surface and an opening in the pickup surface; and a light member for directing light through the opening whereby light can be directed at objects to be retrieved with the pickup surface.

BRIEF DESCRIPTION OF DRAWINGS

A detailed description of preferred embodiments of the present invention follows, with reference to the attached drawings, wherein.

DETAILED DESCRIPTION

Figure 1:
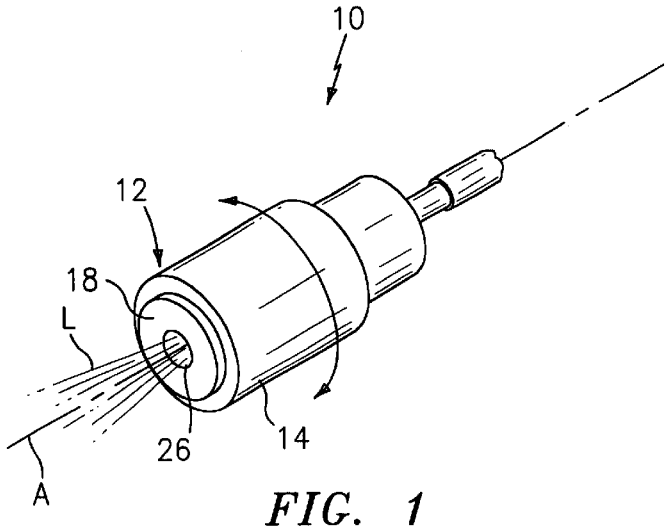
FIG. 1 is a perspective view of a tool according to the present invention.

Referring now to the drawings, a tool 10 in accordance with the invention is illustrated. Tool 10 is a magnetic retrieval tool which is useful for retrieving ferrous or magnetically attractable objects from locations which may be inaccessible or difficult to reach. As will be set forth below, tool 10 in accordance with the present invention includes a light member which can be used to direct light at a location, or an object at a location which is to be retrieved, without requiring removal of the magnet.

FIG. 1 shows a tool head 12 in accordance with the present invention including a magnet member 14 having a light member 16 (see FIG. 2) for directing light L along a central axis A of the tool. As shown in FIG. 1, magnet member 14 is preferably a substantially cylindrical member defining a pickup surface 18 for use in attracting or securing the desired ferrous object.

Figure 2:
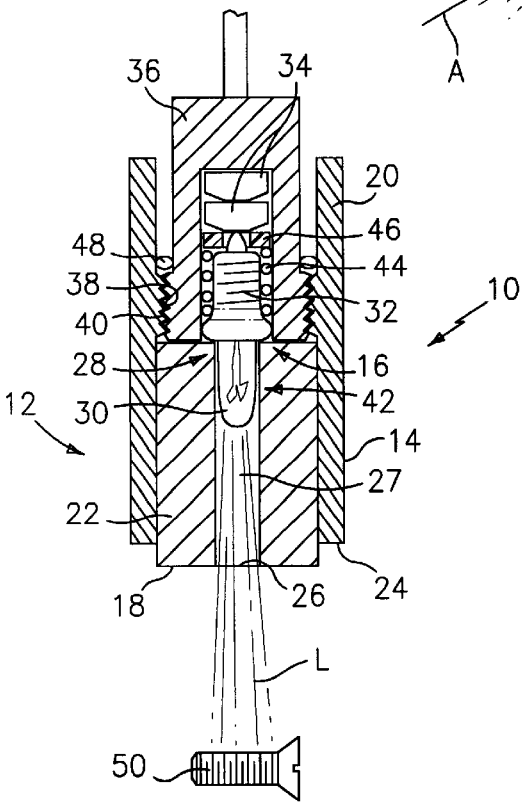
FIG. 2 is a sectional view of a tool according to the present invention.

Referring to FIG. 2, in accordance with a preferred embodiment of the present invention, magnet member 14 includes a sleeve member 20 which is preferably tubular or substantially cylindrical in shape, and a magnet 22 which is mounted to sleeve 20, preferably fixed within sleeve 20 and extending beyond an edge 24 of sleeve 20 as shown. Magnet 22 in accordance with the present invention is advantageously provided with an opening 26 which passes through pickup surface 18 and which may advantageously pass through the entire longitudinal length of magnet 22 as shown in the drawings so as to define a recess 27. Light member 16 preferably includes a light emitting member 28 which may suitably be any conventional light bulb, preferably of a small wattage to suit the intended purpose. Light emitting member 28 may suitably have a bulb portion 30 which is selected to fit within recess 27 as shown in FIG. 2. Light emitting member 28 also includes a conventional contact member 32 for contacting with a conventional battery so as to energize the light emitting member 28 and cause same to emit light. Light member 16 also preferably includes a conventional power source such as one or more batteries 34.

In accordance with the present invention, structure is also advantageously provided for selectively connecting and disconnecting light emitting member 28 with batteries 34. In the illustrated embodiment, this switch structure includes a battery holding member 36 which has external threads 38, and mating internal threads 40 are positioned on an inner surface of sleeve 20. Battery holding member 36 defines a housing area for receiving batteries 34, and further has an open end 42 for slidably receiving contact member 32 of light emitting member 28. As is evident from a consideration of FIGS. 1–3, threads 38, 40 allow for sleeve 20 to be rotated relative to battery holding member 36 so as to longitudinally move sleeve 20 relative to battery holding member 36, along axis A, and thereby selectively contact and separate contact member 32 and batteries 34. Rotation as indicated by the arrows in FIG. 1 thereby turns light member 16 on and off as desired.

Referring back to FIG. 2, it may be desirable to position a spring member 44 between light emitting member 28 and battery holding member 36 or batteries 34 for use in properly positioning light emitting member 28 as desired. It may also be desirable to position a washer 46 within battery holding member 36 so as to properly expose a contact portion of batteries 34 to contact member 32, and also to properly guide contact member 32 into contact with batteries 34 during operation of the switch structure. It may still further be desirable to position a gasket 48 around the rearward most threaded portion of external threads 38 of battery holding member 36 so as to prevent over-tightening and jamming of sleeve 20 relative to battery holding member 36.

In accordance with the present invention, magnet 22 may be any suitable magnet having a sufficient strength for retrieving typical objects such as screws, nails, thumbtacks, socket attachments from socket wrench kits and the like. Of course, different strength magnets could be used for different applications. Specific types of magnets are well known to the person of ordinary skill in the art. The specific light-bulb to be used, as well as the light bulb and battery contacting portions of the present invention are likewise structures well known to a person of ordinary skill in the art.

In use, if an article 50 has been dropped or otherwise is positioned in a dark and inaccessible location, sleeve 20 can be rotated relative to battery holding member 36 so as to contact light emitting member 28 with batteries 34 and thereby energize same. This results in light L being directed along central axis A and through opening 26 of magnet 22 and pickup surface 18 to thereby illuminate an area around article 50 so that pickup surface 18 can be reliably guided to the appropriate position for retrieval of object 50. Once article 50 has been retrieved, sleeve 20 can be rotated in an opposite direction relative to battery holding member 36 so as to disconnect light emitting member 28 from batteries 34 and thereby save battery power for later use when needed. Of course, magnet member 14 of tool 10 in accordance with the present invention can be used without light member activated if lighting around a particular area does not require it.

Figure 3:
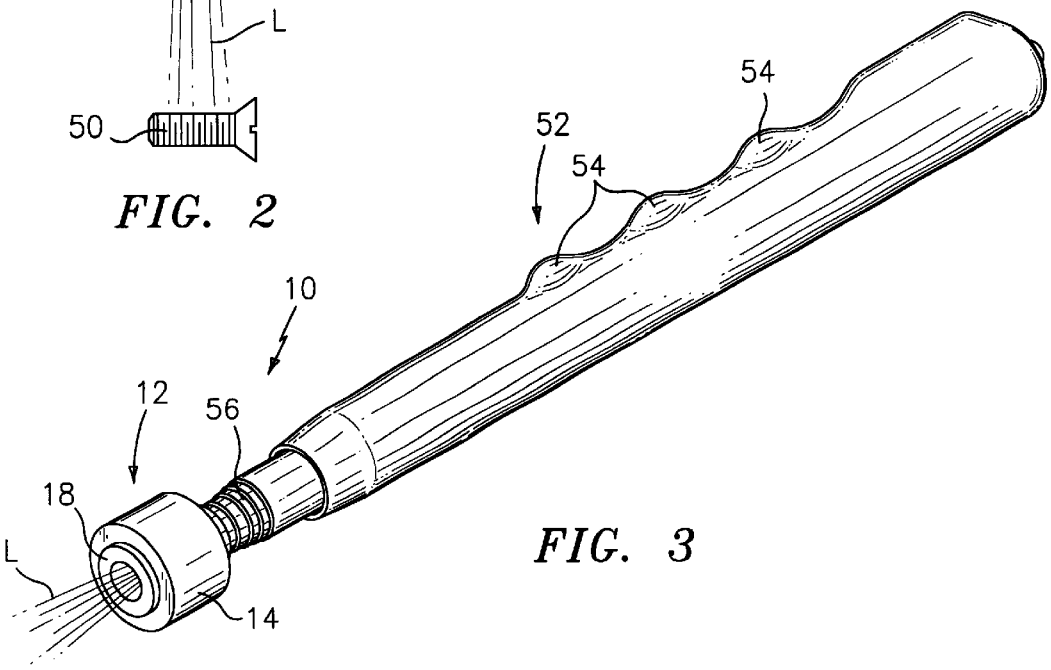
FIG. 3 is a perspective view of a tool according to the invention with a telescoping shaft and handgrip member.

Referring now to FIG. 3, in a preferred embodiment of the present invention, tool 10 includes a handle portion 52 which may desirably be provided with finger grip contours 54. Handle portion preferably extends away from an opposite end of tool head 12 with respect to pickup surface 18 so that pickup surface 18 is properly oriented for use. Further, handle portion 52 may suitably include a telescoping or antenna-like shaft 56 whereby tool head 12 and its magnet member 14 and light member 16 can be extended to provide additional reach to inaccessible and potentially darkened areas for retrieving of articles as desired.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A lighted magnetic retrieval tool, comprising:

a light member having a bulb portion and a rear portion;

a magnet head having a base, a sleeve and a magnet;

the base defining an inner space for holding a battery for the light member and for receiving the rear portion of the light member, and having outwardly directed threads;

the sleeve having inwardly directed threads rotatably engaged with the outwardly directed threads;

the magnet being substantially cylindrical in shape and having an end defining a flat pickup surface with an opening passing through the pickup surface; and the light member being disposed between the magnet and the base, with the bulb portion in the opening and the rear portion in the base, whereby rotating the sleeve relative to the base longitudinally moves the magnet relative to the base whereby the light member is selectively connected to and disconnected from the battery.

2. A tool according to claim 1, wherein the magnet further defines a recess, and wherein the bulb portion of the light member is positioned within the recess for directing light through the opening of the pickup surface.

3. A tool according to claim 1, wherein the magnet member has a central axis, and wherein the light member is positioned to direct light along the central axis through the opening.

4. A tool according to claim 3, further comprising a handle member extending from the magnet member from an end opposite to the pickup surface in a direction away from the pickup surface.

5. A tool according to claim 3, wherein the magnet member and the light member are substantially coaxially positioned along the central axis.

6. A tool according to claim 1, further comprising a handle member extending from the magnet member.

7. A tool according to claim 1, further comprising a washer disposed in the inner space between the battery and the rear portion of the light member.

8. A tool according to claim 1, further comprising a gasket positioned relative to one of the inwardly directed threads and the outwardly directed threads for preventing over-tightening of the sleeve relative to the base.

* * * * *